US009107544B2

(12) United States Patent
Cittadino et al.

(10) Patent No.: US 9,107,544 B2
(45) Date of Patent: Aug. 18, 2015

(54) HOOKLESS SHOWER LINER FASTENER

(75) Inventors: Kyle Cittadino, Wilmington, DE (US); Joseph Vaccaro, West Chester, PA (US)

(73) Assignee: Zenith Products Corporation, New Castle, DE (US)

( * ) Notice: Subject to any disclaimer, the term of this patent is extended or adjusted under 35 U.S.C. 154(b) by 790 days.

(21) Appl. No.: 13/315,498

(22) Filed: Dec. 9, 2011

(65) Prior Publication Data

US 2013/0145543 A1 Jun. 13, 2013

(51) Int. Cl.

| | |
|---|---|
| ***A47K 3/00*** | (2006.01) |
| ***A47K 3/38*** | (2006.01) |
| ***A47H 13/02*** | (2006.01) |
| ***A47H 13/04*** | (2006.01) |

(52) U.S. Cl.

CPC *A47K 3/38* (2013.01); *A47H 13/02* (2013.01); *A47H 13/04* (2013.01); *Y10T 24/51* (2015.01)

(58) Field of Classification Search

USPC ..... 24/716; 4/610

See application file for complete search history.

(56) References Cited

U.S. PATENT DOCUMENTS

| | | | |
|---|---|---|---|
| D118,478 | S | 1/1940 | Herschensohn |
| 2,831,538 | A | 4/1958 | Lishman |
| D223,230 | S | 4/1972 | Kamins et al. |
| 5,111,868 | A | 5/1992 | Sawaya |
| 5,186,232 | A | 2/1993 | Zahner |
| D375,673 | S | 11/1996 | Schowalter |
| 5,769,144 | A | 6/1998 | Carter |
| D419,856 | S | 2/2000 | Richter |
| 6,059,009 | A | 5/2000 | Haiber |
| 6,189,597 | B1 | 2/2001 | Cheng |
| 6,317,904 | B1 | 11/2001 | Samelson |
| D458,831 | S | 6/2002 | Selby |
| 6,494,248 | B1 | 12/2002 | Zahner |
| 6,546,571 | B2 | 4/2003 | Samelson |
| 6,766,848 | B2 | 7/2004 | Cheng |
| 6,866,082 | B1 | 3/2005 | Zahner |
| 6,935,402 | B2 | 8/2005 | Zahner |
| 7,003,848 | B2 * | 2/2006 | Ho ..... 16/87.2 |
| 7,058,988 | B1 | 6/2006 | Zahner |
| D551,950 | S | 10/2007 | Davenport |
| 7,296,609 | B2 | 11/2007 | Zahner |
| 7,735,189 | B2 | 6/2010 | Richardson |
| 7,788,733 | B1 | 9/2010 | Zahner |

(Continued)

OTHER PUBLICATIONS

Hookless Shower Curtains, downloaded from web page: www.shower-curtains.com/hookless-shower-curtains.html, download date: Oct. 11, 2011, original posting date: unknown, 2 pages.

(Continued)

*Primary Examiner* — Janie Christiansen

(74) *Attorney, Agent, or Firm* — Panitch Schwarze Belisario & Nadel LLP

(57) ABSTRACT

A hookless shower liner fastener for suspending a liner and a curtain from a rod mounted in a shower. The hookless shower liner includes a base, a top portion having a thickness and a projection. The base includes a front surface. The top portion has a generally frusta-circular shape and defines a central cavity and a gap. The central cavity is configured to receive at least a portion of a shower rod therein in an installed configuration. The gap is defined between a butt end of the top portion and a butt portion of one of the base and the top portion. The projection extends generally perpendicularly from the front surface. The projection is configured to support the shower curtain to suspend the shower curtain from the rod.

19 Claims, 4 Drawing Sheets

(56) References Cited

U.S. PATENT DOCUMENTS

| | | | | |
|---|---|---|---|---|
| 8,151,385 | B2 * | 4/2012 | Goskowski et al. | 4/610 |
| 2008/0178423 | A1 | 7/2008 | Patel | |
| 2008/0202710 | A1 | 8/2008 | Zahner | |
| 2008/0229491 | A1 | 9/2008 | Gregory | |
| 2010/0065229 | A1 | 3/2010 | Hu | |
| 2010/0319858 | A1 | 12/2010 | Freedland | |
| 2011/0088231 | A1 | 4/2011 | Henry et al. | |
| 2011/0219533 | A1 | 9/2011 | Hu et al. | |
| 2011/0219534 | A1 | 9/2011 | Hu et al. | |

OTHER PUBLICATIONS

White Double H Hookless Shower Curtain, downloaded from web page: Shower-Curtains.com, download date: Oct. 11, 2011, original posting date: unknown, 2 pages.

* cited by examiner

HOOKLESS SHOWER LINER FASTENER

BACKGROUND OF THE INVENTION

Shower liners are typically mounted to a shower rod with individual, separate hooks that suspend the shower liner from the rod. The liner typically includes eyelets along a top edge and the hooks extend through the eyelets and over the rod to hang the liner. The liner may be drawn to a closed position where water from the shower is deflected by the liner back into the shower or tub to prevent water from splashing onto the bathroom floor. Shower liners can have an undesirable aesthetic appearance and shower curtains may be used in combination with a shower liner to improve the aesthetic appearance of the shower. The shower curtain may be suspended by separate hooks from a separate rod or suspended from the same hooks and rod as the liner. The shower curtain provides a relatively appealing aesthetic appearance and may be constructed of materials that are not necessarily water resistant, which can provide a more desirable aesthetic appearance to users and more flexibility.

Shower liners have been constructed with hookless fasteners that are fixedly mounted to a top edge of the liner to suspend the liner from the shower rod. Liners with fixed fasteners permit mounting of the liner without separate shower hooks and shipping the liner with the fasteners mounted thereto. Accordingly, a user hanging the liner with the fixed fasteners does not need to purchase separate individual shower hooks to hang the liner. Users who mount a hookless shower liner with a shower curtain must purchase separate shower hooks to hang the shower curtain with the separate hooks and potentially a second shower rod.

It would be desirable to construct a shower liner and curtain assembly wherein a user mounts a fixed fastener shower liner and shower curtain to the same shower rod without purchasing separate shower hooks. Such a device would preferably simplify assembly for the user and reduce the number of parts required to hang the liner and shower curtain.

BRIEF SUMMARY OF THE INVENTION

Briefly, the preferred embodiment of the present application is directed to a hookless shower liner fastener for suspending a liner and a curtain from a rod mounted in a shower. The hookless shower liner fastener includes a base configured for mounting to the shower, a top portion having a length and a thickness and a projection extending generally perpendicularly from a front surface of the base. The top portion has a generally frusta-circular shape and defines a central cavity and a gap. The central cavity is configured to receive a least a portion of a shower rod therein. The gap is defined between a butt end of the top portion and a butt portion of the base or top portion. The projection is configured to support the shower curtain to suspend the shower curtain from the rod.

In another aspect, a preferred embodiment of the present application is directed to an assembly for mounting to a shower rod in a shower to limit water from splashing onto a bathroom floor and providing a decorative appearance. The assembly includes a liner having a top edge, a bottom edge, a right edge and a left edge. A fastener includes a base, a top portion and a projection extending generally perpendicularly from a front surface of the base or top portion. The base is fixed to a liner proximate the top edge. The top portion defines a central cavity configured to receive the rod therein in a mounted configuration. A shower curtain includes an upper edge and an eyelet proximate the upper edge. The eyelet is configured to surround at least a portion of the projection in the mounted configuration.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
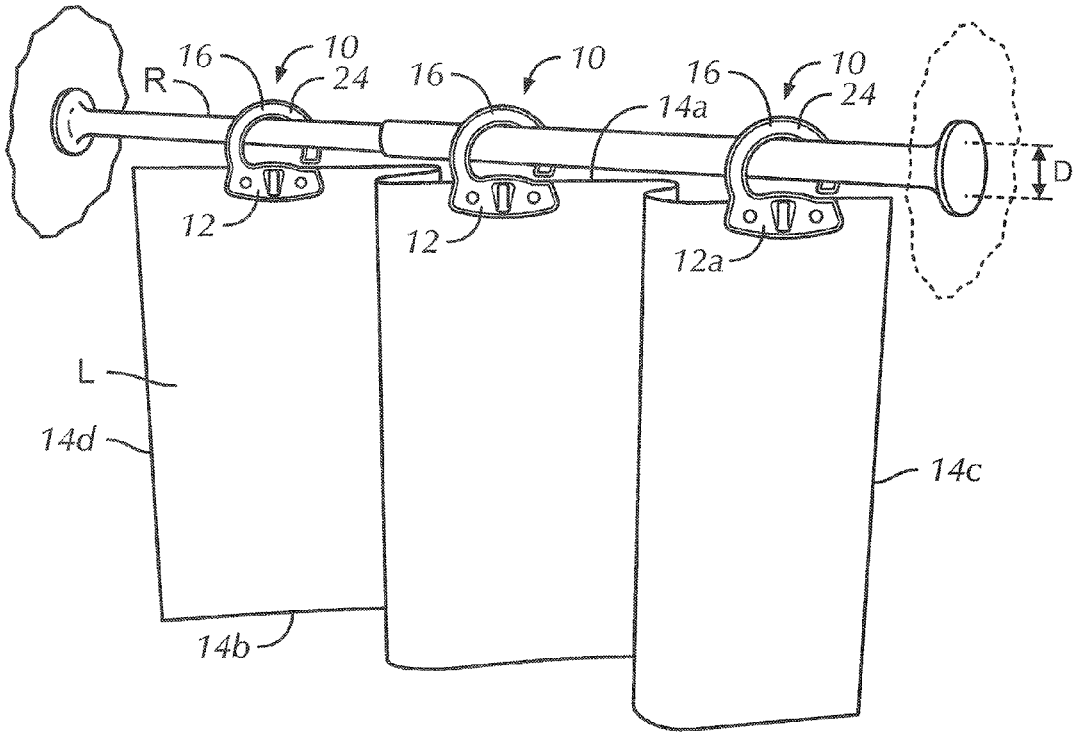
FIG. 1 is a front perspective view of a plurality of three hookless shower liner fasteners suspending a liner from a rod mounted in a shower in accordance with a first preferred embodiment of the present application.
Figure 1A:
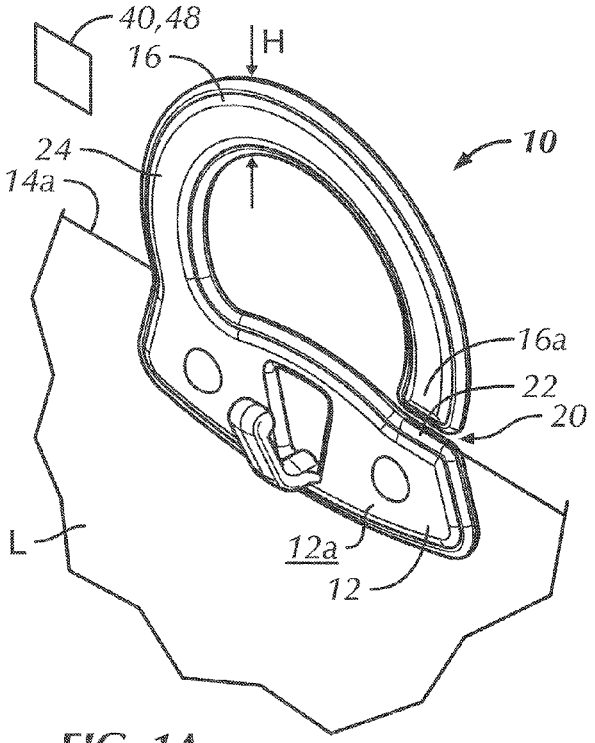
FIG. 1A is a magnified, front perspective, partial fragmentary view of one of the hookless shower liner fasteners of FIG. 1.

Certain terminology is used in the following description for convenience only and is not limiting. The words "right," "left," "lower," and "upper" designate directions in the drawings to which reference is made. The words "inwardly" or "distally" and "outwardly" or "proximally" refer to directions toward and away from, respectively, the geometric center or orientation of preferred hookless shower liner fasteners, a liner, a shower curtain and related parts thereof. The terminology includes the above-listed words, derivatives thereof and words of similar import.

Referring to FIGS. 1-5A, in the preferred embodiments, the present application is directed to a hookless shower liner fastener 10, 10' for suspending a liner or shower liner L and a curtain or shower curtain C from a rod or shower rod R mounted in a shower. The hookless shower liner fasteners 10, 10' of the first and second preferred embodiments are preferably fixedly secured to the liner L such that the hookless shower liner fasteners 10, 10' may be relatively easily assembled to the rod R. The hookless shower liner fasteners 10, 10' of the first and second preferred embodiments will be described using the same reference numerals to identify similar structures, with a prime symbol (') utilized to distinguish the features of the hookless shower liner fastener 10' of the second preferred embodiment from the hookless shower liner fastener 10 of the first preferred embodiment.

Referring to FIGS. 1-4, in the first preferred embodiment, the hookless shower liner fastener 10 includes a base 12 configured for mounting to the shower liner L. The base 12 is preferably fastened or pinned to the liner L such that the liner L is fixed to the base 12. The base 12 may be fixed to the liner L in nearly any manner such as adhesively bonding, clamping, fastening, co-molding or nearly any fastening mechanism or method that results in the base 12 and/or hookless shower liner fastener 10 being fixed to the liner L. A majority of the volume of the liner L preferably extends downwardly from the base 12 or toward a floor of the bathroom from the shower rod R in an installed configuration. In the installed configuration, the liner L preferably extends from the base 12 proximate the rod R toward and nearly to the floor of the bathroom or shower to limit water from splashing out of the shower or tub.

The liner L is preferably constructed of a water-resistant material, such as a polymeric, relatively flexible material. The liner L is preferably water resistant and generally repels and does not absorb water such that the water that is splashed onto the liner L runs back into the shower or tub drain when the liner L encloses the shower or tub.

In the first preferred embodiment, the liner L has a top edge 14*a*, a bottom edge 14*b*, a right edge 14*c*, and a left edge 14*d*. A plurality of fasteners 10 are preferably fixed to the liner L proximate the top edge 14*a*. The plurality of fasteners 10 suspend the liner L from the shower rod R and permit slideable movement of the fasteners 10 along the rod R to open and/or close the shower or tub, as would be apparent to one having ordinary skill in the art upon reviewing this application.

The base 12 includes a front surface 12*a* that preferably faces away from the shower in an assembled configuration (FIG. 1). The front surface 12*a* may have a decorative appearance to be aesthetically pleasing to users when assembled to the shower rod R.

The hookless shower liner fastener 10 also includes a top portion 16 having a thickness T. The top portion 16 has a generally frusta-circular or hook-like shape and defines a central cavity 18 and a gap 20. The central cavity 18 is configured to receive at least a portion of the shower rod R in the assembled configuration. In the first preferred embodiment, the shower rod R is positioned in the central cavities 18 of the plurality of fasteners 10 to suspend the liner L from the shower rod R.

The gap 20 is defined between a butt end 16*a* of the top portion 16 and a butt portion 22 of one of the base 12 and the top portion 16. In the first preferred embodiment, the gap 20 is relatively narrow and is defined between the butt end 16*a* of the top portion 16 and the butt portion 22 at a top edge of the base 12 proximate the butt end 16*a*. The gap 20 of the fastener 10 of the first preferred embodiment is significantly smaller than a diameter D of the shower rod R. The gap 20 permits insertion of the rod R into the central cavity 18 to assemble the plurality of fasteners 10 and liner L to the shower rod R.

Figure 2:
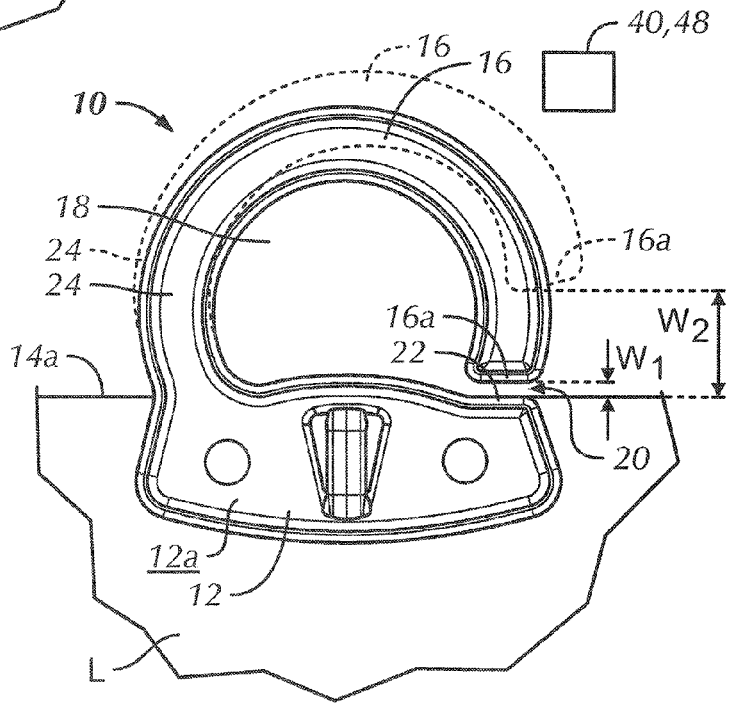
FIG. 2 is a front elevational, partial fragmentary view of the hookless shower liner fastener and the shower liner of FIG. 1A.

In the first preferred embodiment, the top portion 16 is constructed of a relatively strong, elastic material, such as a polymeric material. The gap 20 defines a first gap width $W_1$ in a relaxed configuration and a second gap width $W_2$ in an expanded configuration. In the expanded configuration, the top portion 16 is designed and adapted to elastically deform to accommodate or define the second gap width $W_2$ (FIG. 2). The second gap width $W_2$ is greater than the first gap width $W_1$.

In the first preferred embodiment, the top portion 16 has a relatively constant thickness T and a relatively constant height H, wherein the height H is greater than the thickness T. The top portion 16 is able to elastically deform and/or twist relative to the base 12 to define the second gap width $W_2$. The top portion 16 of the first preferred embodiment is able to deform such that the second gap width $W_2$ is greater than the diameter D of the rod R. Accordingly, in a deformed configuration, the rod R is able to slide through the gap 20, having the second gap width $W_2$, into the central cavity 18 and the relatively elastic top portion 16 is generally able to move back to its original shape, wherein the gap 20 defines the first gap width $W_1$ to generally secure the fastener 10 to the rod R. The top portion 16 is not limited to deforming and/or twisting relative to the base 12 and may be generally deformable itself to expand the gap 20 from the first gap width $W_1$ to the second gap width $W_2$ and elastically flex back to the first gap width $W_1$. Alternatively, the top portion 16 or base 12 may include a movable member (not shown), such as a swinging gate that is able to expose the central cavity 18 or expand the gap 20 for insertion of the rod R into the central cavity 18. In addition, multiple alternative arrangements that accommodate insertion of the rod R into the central cavity 18 through the gap 20 could be devised by one having skill in the art, such as the gate or a clam shell-type configuration.

In addition, the fastener 10 is not limited to having a deformable top portion 16, base 12 or gap 20 that is expandable between the first and second gap width $W_1$, $W_2$ to accommodate insertion of the rod R into central cavity 18. For example, the gap 20 may be large enough to accommodate insertion of the shower rod R therethrough for positioning in the central cavity 18. However, the deformable top portion 16 is preferred for the first preferred embodiment to generally secure the fastener 10 to the shower rod R and limit the chances that the shower rod R inadvertently slides off of the rod R.

Figure 3:
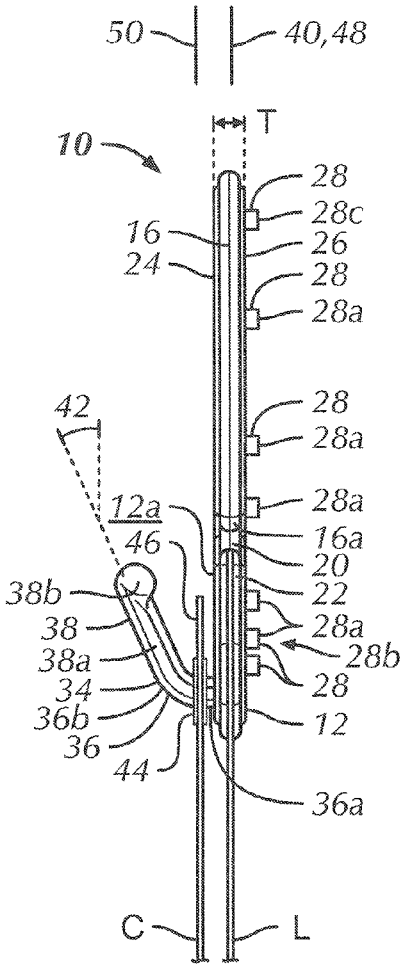
FIG. 3 is a left-side elevational view of the hookless shower liner fastener and associated shower liner of FIG. 1A and a shower curtain mounted thereto.
Figure 4:
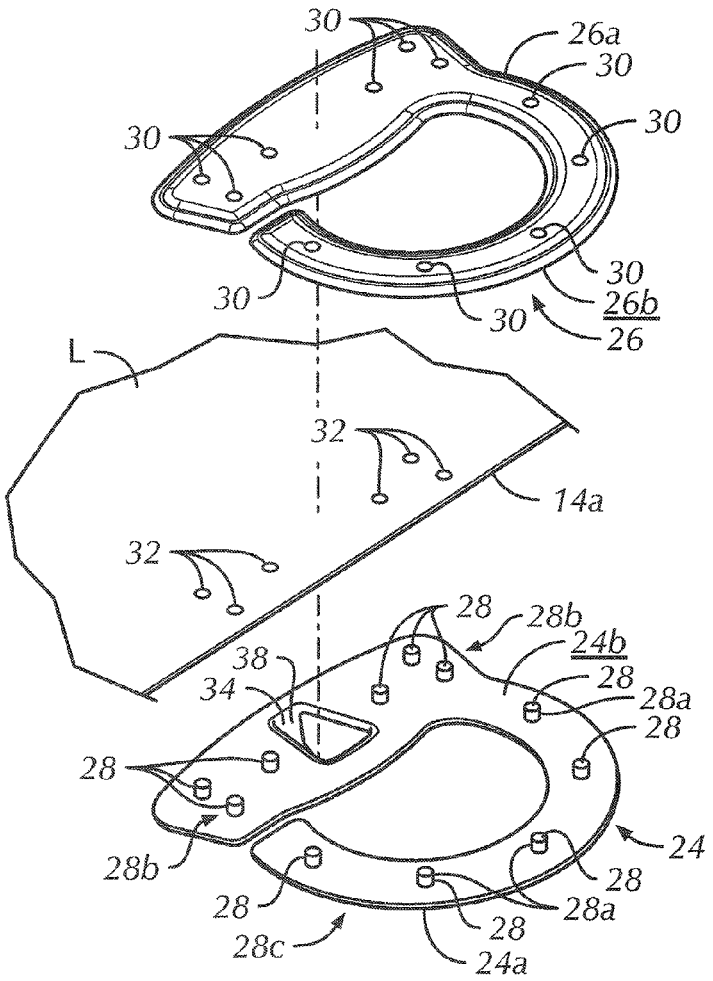
FIG. 4 is a partial fragmentary, exploded view of the hookless shower liner fastener and associated liner of FIG. 1A.

Referring to FIG. 3, in the first preferred embodiment, the base 12 and top portion 16 are comprised of a first portion 24 and a second portion 26. in the first preferred embodiment, the first portion 24 has a first edge 24*a* and a first inner surface 24*b*. The second portion 26 has a second edge 26*a* and a second inner surface 26*b*. The first and second edges 24*a*, 24*b* are in facing engagement in an assembled configuration. Specifically, the first and second portions 24, 26 are assembled with the first and second edges 24*a*, 26*a* in facing engagement to define the fastener 10 of the first preferred embodiment. The fastener 10 is not limited to inclusion of the first and second portions 24, 26 and may be constructed of a single, integrally formed component or multiple additional components to define the fastener 10. However, in the first preferred embodiment, the fastener 10, base 12 and top portion 16 are defined by assembly of the first and second portions 24, 26.

Referring to FIGS. 1-4, the first portion 24 of the first preferred embodiment includes a plurality of posts 28 extending from the first inner surface 24*b*. The plurality of posts 28 preferably have a generally cylindrical configuration and extend generally perpendicularly from the first interface 24*b*. The second portion 26 of the first preferred embodiment includes a plurality of holes 30 that extend therethrough. The plurality of posts 28 extend through the plurality of holes 30 in the assembled configuration to secure the first portion 24 to the second portion 26. Some or all of the plurality of posts 28 also preferably extend through penetrations or scores 32 in the liner L to further secure the liner L to the fastener 10, as will be described in greater detail below.

In the assembled configuration, tips 28*a* of the plurality of posts 28 are heat sealed, sonic welded, plastically deformed, adhesively bonded, fastened, clamped or otherwise adapted to secure the first portion 24 to the second portion 26. For example, the tips 28*a* may be sonic welded or plastically deformed to expand the diameter of the generally cylindrical plurality of posts 28 at the tips 28*a* to prevent the plurality of posts 28 from sliding back through the plurality of holes 30 in the second portion 26, thereby securing the first portion 24 to the second portion 26. The first portion 24 is not limited to being secured to the second portion 26 through the plurality of posts 28 and holes 30 of the first preferred embodiment, but may be clamped, fastened, adhesively bonded, or otherwise mounted together to define the fastener 10 of the first preferred embodiment. Alternatively, the fastener 10 may be integrally molded in a single piece or may be assembled via multiple alternative components to define the fastener 10.

In the first preferred embodiment, the plurality of posts 28 include a first post 28*b* that extends through the liner L in the assembled configuration and a second post 28*c* that does not extend through the liner L. The first post 28*b* preferably includes six (6) first posts 28*b* and the second post 28*c* preferably includes five (5) second posts 28*c*. The first posts 28*b* preferably extend through certain of the plurality of holes 30 in the second portion 26 and the penetrations or scores 32 in the liner L, thereby sandwiching the liner L between the first and second portions 24, 26 and resulting in the first posts 28*b* extending through the penetrations or scores 32 to further secure the liner L to the fastener 10. The liner L is not limited to including the penetrations or scores 32 and the first posts 28*b* may be forced through the liner L proximate the top edge 14*a* during assembly or the plurality of post 28 may be configured such that they do not extend through the liner L.

In the first preferred embodiment, the first posts 28*b* are formed on the base 12 and the second posts 28*c* are formed on the top portion 16. However, the fastener 10 is not limited to having the first posts 28*b* formed on the base 12 and the second post 28*c* formed on the top portion 16 or to the inclusion of first and or second posts 28*b*, 28*c*. For example, all of the plurality of posts 28 may be configured to extend through the liner L, wherein the liner L extends above the top portion 16 in the assembled configuration and is scored to provide access to the gaps 20 for insertion of the shower rod R. Alternatively, the liner L may be secured to the fastener 10 exclusively at the first and second edges 24*a*, 26*a* proximate the base 12. However, it is preferred that the first posts 28*b* extend through the liner L to provide additional vertical support for engaging the fastener 10 to the liner L and generally preventing the liner L from disengaging from the fastener 10.

In the first preferred embodiment, the front surface 12*a* is located on the first portion 24. Accordingly, the front surface 12*a* may have a more aesthetically pleasing appearance by a user because the plurality of posts 28 are hidden when observing the front surface 12*a*. Therefore, the front surface 12*a* is preferably exposed or faces away from the shower in the assembled configuration (FIG. 1).

A projection 32 extends generally perpendicularly from the front surface 12*a*. The projection 34 is configured to support the shower curtain C to suspend the shower curtain C from the rod R. In the first preferred embodiment, the projection 34 is integrally formed with the first portion 24 and extends generally perpendicularly from the front surface 12*a* in a direction generally opposite from that of the plurality of posts 28. The projection 34 preferably includes a first segment 36 that extends nearly perpendicularly from the first surface 12*a* and a second segment 38 that extends at an acute angle, generally upwardly relative to the first segment 36. The first segment 36 preferably includes a proximal end 36*a* attached to the base 12 and a distal end 36*b*. The second segment 38 preferably includes a first end 38*a* that is secured to the distal end 36*b* and a head 38*b* spaced from the first end 38*a* at the apex of the projection 34. The projection 34 is not limited to inclusion of the first and second segments 36, 38 and the arrangement described in the first preferred embodiment, but a configuration where the head 38*b* is positioned above the proximal end 36*a* is preferred to generally prevent the shower curtain C from inadvertently sliding off of the projection 34, as will be described in greater detail below.

The shower liner L defines a liner plane 40 in the first preferred embodiment. The base 12 is oriented generally parallel to the liner plane 40 in the first preferred embodiment. As would be apparent to one having ordinary skill in the art, the liner L is constructed of a generally flexible and elastic material that may result in a generally wavy appearance in the assembled and/or installed configuration. However, the liner L proximate the individual fasteners 10 preferably defines the liner plane 40 that is generally parallel to the base 12, the top portion 16 and the front surface 12*a* in the assembled configuration. However, the liner L is not limited to defining a liner plane 40 that is generally parallel to the base 12, top portion 16 and front surface 12*a*, as the base 12, top portion 16 and/or front face 12*a* may be angled or curved, thereby resulting in the liner L not necessarily defining a plane. In addition, the top portion 16 may be pivotably or rotatably mounted to the base 12 such that any liner plane 40 would not necessarily be generally parallel to the top portion 16.

The second segment 38 and liner plane 40 define a second segment angle 42 in the first preferred embodiment. The second segment angle 42 is an acute angle. The second segment 38 preferably extends upwardly relative to the first segment 36 to generally limit or avoid sliding of the shower curtain C off of the projection 34.

The head 38*b* of the first preferred embodiment includes or is comprised of an enlarged section that, in combination with the second segment 38 extending at the second segment angle 42 from the first segment 36 limits or avoids sliding of the shower curtain C off of the projection 34. The head or enlarged segment 38*b* generally blocks and eyelet 44 of the curtain C from sliding off of the end of the projection 34 or resists such sliding of the eyelet 44 over the head 38*b*. In the first preferred embodiment, the first projection 34 is integrally formed with the first portion 24, preferably by injection molding of a polymeric material.

Referring to FIGS. 1 and 2, in an assembled configuration, the plurality of fasteners 10 mounted to the top edge 14*a* of the liner L with the curtain C suspended from the projections 34 is mounted or hung from the shower rod R to limit water from splashing onto a bathroom floor and to provide a decorative appearance to the shower. The eyelets 44 at an upper edge 46 of the shower curtain C are positioned to hang from the projection 34, specifically on the first segment 36. The eyelets 44 preferably include a hole or gap slightly larger than the head 38*b* and the eyelets 44 are generally limited from sliding off of the projection 34 by the upward extension of the second segment 38 at the second segment angle 42 and the head 38*b*. The curtain C preferably has a decorative appearance and extends generally parallel to the liner L in the assembled configuration.

Accordingly, the curtain C provides a relatively decorative appearance to the shower, while the liner L is preferably moisture resistant and is able to deflect water back into the shower. The decorative appearance of the curtain C is thereby not limited to materials that are water resistant or able to deflect water back into the shower and a wider variety of materials may be utilized for the decorative appearance of the curtain C.

Referring to FIG. 3, in the first preferred embodiment, the shower curtain C defines a curtain plane 50 that is generally parallel to and spaced from the liner and fastener planes 40, 48. Similarly, the curtain C is constructed of a relatively elastic, flexible material that may have a generally wavy appearance in the assembled and installed configurations. However, at least proximate the fasteners 10 at the eyelet 44, the curtain C preferably defines the curtain plane 50 that is generally parallel to the liner and fastener planes 40, 48. The curtain plane 50 is not limited to being generally parallel to the liner plane 40 and/or fastener plane 48 and may be generally pitched when positioned on the first segment 38. In addition, in the assembled configuration, the eyelet 44 may be curved or angled to provide a unique aesthetic appearance.

Figure 5A:
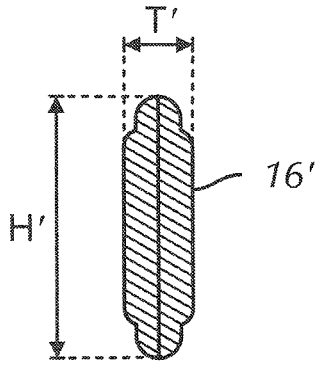
FIG. 5A is a cross-sectional view of a top portion of the hookless shower liner fastener of FIG. 5, taken along line 5A-5A of FIG. 5.
Figure 5:
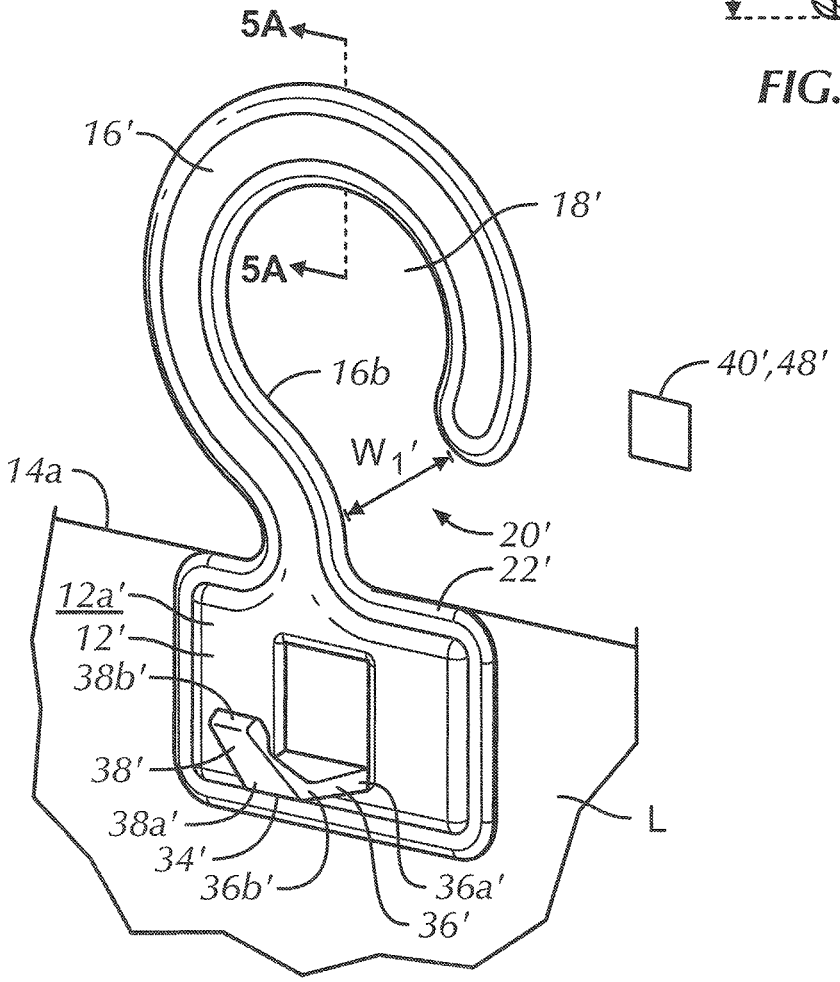
FIG. 5 is a front perspective view of a hookless shower liner fastener and an associated liner in accordance with a second preferred embodiment of the present application.

Referring to FIGS. 5 and 5A, in the second preferred embodiment, the fastener 10' is constructed of a top portion 16' that has a generally hook-shape, similar to a clothes hanger. The construction and operation of the fastener 10' of the second preferred embodiment is similar to the fastener 10 of the first preferred embodiment. In the second preferred embodiment, the first gap width $W_1'$ of the gap 20' is larger than the first gap width $W_1$ of the gap 20 of the first preferred embodiment and may be large enough for the diameter D of the rod R to extend therethrough without deforming the top portion 16' or base 12'. However, the first gap width $W_1'$ of the gap 20' is not limited to being greater than the diameter D of the rod R to accommodate insertion therein to the central cavity 18' and the first gap width $W_1'$ of the gap 20' may be smaller than the diameter D of the rod R, thereby necessitating deformation of the top portion 16' and/or base 12' to insert the rod R into the central cavity 18'.

In addition, in the second preferred embodiment, the gap 20' is defined between the butt end 16*a*' of the top portion 16 and a base segment 16*b*' of the top portion 16' proximate to engagement of the top portion 16' with the base 12'. The gap 20' is not limited to being defined between the butt end 16*a* and the base segment 16*b* and may be defined between the butt end 16*a*' and the base 12' or between the butt end 16*a*' and another portion of the top portion 16', as long as the rod R is positionable within the central cavity 18' in the installed configuration.

Referring to FIGS. 1-5A, to assemble the hookless shower liner fasteners 10, 10' to the liner L, penetrations or scores 32 may be formed in the liner L for alignment with the first posts 28*b*. The first portion 24 is aligned proximate the top edge 14*a* of the liner L such that the first posts 28*b* are lined with the penetrations or scores 32 and the corresponding holes 30 in the second portion 26. The first posts 28*b* are urged through the penetrations or scores 32 and through the corresponding plurality of holes 30 and the plurality of posts 28 are urged through the plurality of holes 30 in the second portion 26 such that the first and second edges 24*a*, 26*a* are in facing engagement and the first and second inner faces 24*b*, 26*b* are facing each other. The tips 28*a* of the plurality of posts 28 are subsequently heat sealed, sonic welded, plastically deformed, adhesively bonded, fastened, clamped or otherwise manipulated to secure the first portion 28, section portion 26 and liner L in an assembly.

When a plurality of the hookless shower liner fasteners 10 are engaged to the top edge 14*a* of the liner L, the assembly is mounted to the shower rod R. In the first preferred embodiment, the top portion 16 is generally twisted or bent relative to the base 12 to expand the gap 20 from the first gap width $W_1$ to the second gap width $W_2$ to accommodate sliding of the rod R into the central cavity 18. Once the rod R is in the central cavity 18, the top portion 16 and base 12 flex back to their relaxed configuration, thereby reducing the gap 20 to the first gap width $W_1$ and securing the fastener 10 to the rod R. In the second preferred embodiment, the rod R is able to slide through the gap 20' into the cavity 18', potentially without deforming the top portion 16' and/or base 12'. The curtain C may then be mounted to the fasteners 10, 10' by sliding the eyelets 44 over the head 38*b*, 38*b*' and positioning the eyelets 44 on the first segments 36, 36'. The weight of the curtain C secures the eyelets 44 on the first segment 36, 36' and generally limits sliding of the eyelets 44 off of the projection 34, 34' as a result of a combination of the second segment angle 42 and enlarged head 38*b*, 38*b*'. When mounted to the rod R, the liner L preferably acts as a barrier to limit water from splashing onto a bathroom floor from the shower and the curtain C provides a decorative appearance to the bathroom or shower. In addition, the assembly permits mounting of the liner L and curtain C without the necessity of purchasing separate shower hooks (not shown) for hanging from the rod R and/or purchase of a second rod.

It will be appreciated by those skilled in the art that changes could be made to the embodiments described above without departing from the broad inventive concept thereof. For example, the fastener 10' of the second preferred embodiment may be constructed of a one-piece molded polymeric material and the liner L may be adhesively bonded to a rear surface of the fastener 10'. It is understood, therefore, that this invention is not limited to the particular embodiments disclosed, but it is intended to cover modifications within the spirit and scope of the present invention as defined by the appended claims.

We claim:

1. A hookless shower liner fastener for suspending a liner and a curtain from a rod mounted in a shower, the hookless shower liner fastener comprising:

a base configured for mounting to the shower liner, the base including a front surface defining a window opening therethrough;

a top portion having a thickness, the top portion having a generally frusta-circular shape and defining a central cavity and a gap, the central cavity configured to receive at least a portion of a shower rod therein, the gap defined between a butt end of the top portion and a butt portion of one of the base and the top portion; and a projection extending generally perpendicularly from the front surface adjacent to the window opening, the projection configured to support the shower curtain to suspend the shower curtain from the rod, wherein said shower liner defines a liner plane and the projection has a first segment extending generally perpendicularly from a bottom edge of the window opening and that is generally perpendicular to the liner plane and a second segment that extends at an acute angle to the liner plane.

2. The hookless shower liner fastener of claim 1 wherein the base and top portion are comprised of a first portion and a second portion, the first portion having a first edge and a first inner surface, the second portion having a second edge and a second inner surface, the first and second edges being in facing engagement in an assembled configuration.

3. The hookless shower liner fastener of claim 2 further comprising:

a plurality of posts extending from the first inner surface; and a plurality of holes through the second portion, the plurality of posts extending through the plurality of holes in the assembled configuration to secure the first portion to the second portion.

4. The hookless shower liner fastener of claim 3 wherein tips of the plurality of posts are one of heat sealed, sonic welded, plastically deformed, adhesively bonded, fastened and clamped to the second portion adjacent the plurality of holes in the assembled configuration.

5. The hookless shower liner fastener of claim 3 wherein the base includes a first post, the first post comprising at least one of the plurality of posts, the first post configured to extend through the liner.

6. The hookless shower liner fastener of claim 1 wherein the first segment of the projection includes a proximal end and a distal end, and the second segment of the projection includes a first end and a head, the first end being secured to the distal end.

7. The hookless shower liner fastener of claim 6, wherein the base is oriented generally parallel to the liner plane.

8. The hookless shower liner fastener of claim 6 wherein the head includes an enlarged section, the enlarged section in combination with the second segment angle configured to limit the shower curtain from sliding off of the projection.

9. The hookless shower liner fastener of claim 6 wherein the first segment and the projection are integrally formed.

10. The hookless shower liner fastener of claim 1 wherein the base, top portion and projection and constructed of a polymeric material.

11. The hookless shower liner fastener of claim 1 wherein the top portion is constructed of an elastic material, the gap defining a first gap width in a relaxed configuration, the top portion configured to elastically deform to define a second gap width, the second gap width being greater than the first gap width.

12. The hookless shower liner fastener of claim 11 wherein the second gap width is greater than a diameter of the shower rod.

13. The hookless shower liner fastener of claim 1 wherein the base and top portion are comprised of a first portion and a second portion, the front surface located on the first portion.

14. An assembly for mounting to a shower rod in a shower to limit water from splashing onto a bathroom floor and providing a decorative appearance, the assembly comprising:

a liner having a top edge, a bottom edge, a right edge and a left edge, said liner defining a liner plane;

a fastener including a base with a front surface and defining a window opening therethrough, a top portion and a projection extending from the front surface of the base adjacent the window opening, the base fixed to the liner proximate the top edge, the top portion defining a central cavity configured to receive the rod therein in a mounted configuration, wherein the projection has a first segment extending generally perpendicularly from a bottom edge of the window opening and that is generally perpendicular to the liner plane and a second segment that extends at an acute angle to the liner plane; and a shower curtain defining a curtain plane, said shower curtain including an upper edge and an eyelet proximate the upper edge, the eyelet configured to surround the first segment of the projection in the mounted configuration so that the shower curtain suspends from the first segment and the curtain plane is generally parallel to the liner plane.

15. The assembly of claim 14, wherein the fastener comprises a plurality of fasteners fixed to the liner proximate the top edge and the eyelet comprises a plurality of eyelets, each of the plurality, of eyelets configured to surround one of a plurality of projections of the plurality of fasteners, respectively.

16. The assembly of claim 15, wherein the fastener defines a fastener plane, the liner plane and the fastener plane being coplanar.

17. The assembly of claim 16 wherein the shower curtain defines a curtain plane, the curtain plane being generally parallel to and spaced from the liner and fastener planes.

18. The assembly of claim 14 wherein the first segment of the projection includes a proximal end and a distal end, and the second segment of the projection includes a first end and a head, the first end being secured to the distal end.

19. The assembly of claim 14 wherein the fastener includes a head with an enlarged section, the enlarged section limiting the shower curtain from sliding off of the projection in the mounted configuration.

* * * * *